US006096378A

United States Patent [19]

Komatsu et al.

[11] Patent Number: 6,096,378

[45] Date of Patent: Aug. 1, 2000

[54] PROCESS FOR FORMATION OF MULTI-LAYER FILM

[75] Inventors: Yoshiharu Komatsu; Kazuhito Niida, both of Sayama; Shigeru Kuramochi; Yasuyuki Suzuki, both of Kanuma, all of Japan

[73] Assignees: Kansai Paint Co., Ltd., Hyogo-ken; Honda Giken Kogyo Kabushiki Kaisha, Tokyo, both of Japan

[21] Appl. No.: 08/970,761

[22] Filed: Nov. 14, 1997

[30] Foreign Application Priority Data

Nov. 15, 1996 [JP] Japan ..... 8-318484

[51] Int. Cl.[7] ..... B05D 7/14

[52] U.S. Cl. ..... 427/407.1

[58] Field of Search ..... 427/409

[56] References Cited

U.S. PATENT DOCUMENTS

| | | | |
|---|---|---|---|
| 4,539,258 | 9/1985 | Panush | 428/324 |
| 4,551,491 | 11/1985 | Panush | 524/31 |
| 4,756,975 | 7/1988 | Fujii et al. | 428/461 |
| 5,108,796 | 4/1992 | Yamanaka et al. | 427/379 |
| 5,326,596 | 7/1994 | Kasari et al. | 427/379 |
| 5,556,527 | 9/1996 | Igarashi et al. | 204/488 |
| 5,676,813 | 10/1997 | Nakamura et al. | 205/50 |
| 5,698,310 | 12/1997 | Nakamura et al. | 428/328 |
| 5,718,950 | 2/1998 | Komatsu et al. | 427/405 |

FOREIGN PATENT DOCUMENTS 2 295 974 6/1996 United Kingdom .

*Primary Examiner*—Shrive Beck
*Assistant Examiner*—Jennifer Kolb
*Attorney, Agent, or Firm*—Wenderoth, Lind & Ponack, LLP

[57] ABSTRACT

The present invention provides a process for forming a multilayer film by applying, on a substrate, the following coatings in the following order: (A) a primer, (B) an intermediate coating, C) a coloring base coating, (D a pearl-like base coating, and (E) a clear coating, in which process the intermediate coating (B) is a liquid thermosetting coating containing a thermosetting resin composition, a fine aluminum powder having an average particle diameter of less than 10 $\mu$m and a titanium oxide pigment, the amounts of the fine aluminum powder and the titanium oxide pigment being 0.1–30 parts by weight and 1–200 parts by weight, respectively, per 100 parts by weight of the thermosetting resin composition so that a film formed from the liquid thermosetting coating has a hiding powder of 25 $\mu$m or less; the coloring base coating (C) is a coating containing a thermosetting resin composition, a titanium white pigment and an aluminum flake, the amounts of the titanium white pigment and the aluminum flake being such that a film formed from the coating has a value of N 7 to N 9 in Munsell's color system; and the pearl-like base coating (D) is a white-pearl-like or silver-pearl-like coating containing a thermosetting resin composition and a scaly mica powder coated with titanium oxide. The process enables formation of a multilayer film superior in chipping resistance, high white-iridescent appearance, color stability, etc. even when having a small total film thickness.

26 Claims, No Drawings

PROCESS FOR FORMATION OF MULTI-LAYER FILM

The present invention relates to a process for forming a multilayer film superior in chipping resistance, high white-iridescent appearance, color stability, etc. even when having a small film thickness. The process is suitably used for coating of, in particular, the body panel, color bumper, etc. of automobile.

It is already in practice to form an iridescent film by the use of a coating containing a scaly mica powder coated with a metal oxide such as titanium oxide or the like. It is already known, for example, to form a multilayer film by applying, on a primer-coated surface, an organic solvent type base color capable of forming a film of N 4 to N 8 in Munsell's color system, then applying, without curing the above-applied base color, an organic solvent type transparent iridescent coating containing a mica powder coated with a metal oxide and also a clear coating, and heat-curing the above-applied three coatings simultaneously (see, for example, U.S. Pat. No. 4,539,258). The multilayer film formed by the above approach, however, is insufficient in hiding power (color stability) for base color film (this necessitates the formation of the base color film in a large film thickness) and moreover inferior in high white-iridescent appearance. These drawbacks of the multilayer film are very serious when the multilayer film is formed on the body panel of automobile wherein the appearance of the film is important. Hence, the drawbacks need be eliminated urgently.

In this connection, the present applicant previously proposed that the above drawbacks can be eliminated by using, as the organic solvent type base coating, a coating containing a titanium white pigment and an aluminum flake so as to be able to form a film of N 7 to N 9 in Munsell's color system (see GB-A-225974).

The present applicant made a further study. As a result, the present applicant found that by using, as an intermediate coating to be applied prior to the application of the organic solvent type base color, a liquid thermosetting coating containing a thermosetting resin composition, a fine aluminum powder having an average particle diameter of less than 10 μm and a titanium oxide pigment, the amounts of the fine aluminum powder and the titanium oxide pigment being 0.1–30 parts by weight and 1–200 parts by weight, respectively, per 100 parts by weight of the thermosetting resin composition so that a film formed from the liquid thermosetting coating has a hiding powder of 25 μm or less, the total thickness of the resulting multilayer film can be made small and the properties (e.g. chipping resistance) of the multilayer film can be improved further. The present invention has been completed based on the finding.

According to the present invention, there is provided a process for forming a multi layer film by applying, on a substrate, the following coatings in the following order:

(A) a primer, (B) an intermediate coating, (C) a coloring base coating, (D) a pearl-like base coating, and (E) a clear coating, in which process the intermediate coating (B) is a liquid thermosetting coating containing a thermosetting resin composition, a fine aluminum powder having an average particle diameter of less than 10 μm and a titanium oxide pigment, the amounts of the fine aluminum powder and the titanium oxide pigment being 0.1–30 parts by weight and 1–200 parts by weight, respectively, per 100 parts by weight of the thermosetting resin composition so that a film formed from the liquid thermosetting coating has a hiding powder of 25 μm or less; the coloring base coating (C) is a coating containing a thermosetting resin composition, a titanium white pigment and an aluminum flake, the amounts of the titanium white pigment and the aluminum flake being such that a film formed from the coating has a value of N 7 to N 9 in Munsell's color system; and the pearl-like base coating (D) is a white-pearl-like or silver-pearl-like coating containing a thermosetting resin composition and a scaly mica powder coated with titanium oxide.

The process for formation of multilayer film according to the present invention (the process is hereinafter referred to as "the present process") is described below in detail.

Primer (A)

The primer (A) is a coating to be directly applied to a substrate made of a metal, a plastic or the like, i.e. a material to be coated so that the resulting material can have rust-proofness, adhesivity, etc. The primer (A) has no particular restriction as to the kind and, in the present process, there can be used any ordinary primer as long as it achieves the above object. The substrate to which the primer (A) is applied, is particularly preferably the body panel of automobile. It is usually desirable that the substrate is beforehand subjected to appropriate treatments such as rust prevention, washing, chemical treatment and the like.

When the substrate is metallic-made or has surface conductivity, the primer (A) is preferably a cationic electrocoating. The cationic electrocoating has no particular restriction as to its kind and can be a per se known cationic electrocoating obtained by mixing an aqueous solution or dispersion of a salt of a cationic polymer, as necessary with a crosslinking agent, a pigment and additives. The cationic polymer includes, for example, an acrylic resin or epoxy resin which has a crosslinkable functional group and to which a cationic group (e.g. an amino group) is introduced, and these resins can be made water-soluble or water-dispersible by neutralization with an organic acid, an inorganic acid or the like. The crosslinking agent usable to cure said resin is preferably a blocked polyisocyanate, an alicyclic epoxy resin or the like.

In applying the cationic electrocoating, electrodeposition is conducted; that is, a metallic material as substrate (e.g. an automobile body panel or a bumper) is immersed as a cathode in a bath consisting of said cationic electrocoating, and an electric current is passed between said cathode and an anode under ordinary conditions to precipitate the above-mentioned resin, etc. on the metallic material. The preferable thickness of the resulting electrocoating film is generally 10–40 μm, preferably 20–35 μm as cured. The film can be crosslinked and cured by heating generally at about 140–220° C. for about 10–40 minutes. In the present process, an intermediate coating may be applied before the cationic electrocoating is cured; however, it is generally preferable that the intermediate coating is applied after the cationic electrocoating has been cured.

Intermediate Coating (B)

In the present process, there is used, as the intermediate coating (B), a liquid thermosetting coating containing a thermosetting resin composition, a fine aluminum powder having an average particle diameter of less than 10 μm and a titanium oxide pigment, the amounts of the fine aluminum powder and the titanium oxide pigment being 0.1–30 parts by weight and 1–200 parts by weight, respectively, per 100 parts by weight of the thermosetting resin composition so that a film formed from the liquid thermosetting coating has a hiding powder of 25 μm or less.

By using, in the intermediate coating (B), a fine aluminum powder and a titanium oxide pigment in combination, the following effects can be obtained. That is, a film formed from the intermediate coating (B) has a large hiding power and can sufficiently hide the substrate [the film of the primer (A)] even when the film has a small thickness of less than 25 μm or less, particularly 10–25 μm; moreover, when the coloring base coating (C) is applied on the uncured film of the intermediate coating (B) to form a film of the coloring base coating (C), no mixing of the two films takes place. Further, since the aluminum powder used in the intermediate coating (B) has very small diameters and is fine, the film formed from the intermediate coating (B) usually has no glittering metallic appearance.

The thermosetting resin composition used as a vehicle component in the intermediate coating (B), basically comprises a base resin and a crosslinking agent. As the base resin, there can be mentioned, for example, an acrylic resin, a polyester resin and an alkyd resin all having, in the molecule, at least two crosslinkable functional groups selected from hydroxyl group, epoxy group, isocyanate group and carboxyl group, etc. A polyester resin is particularly preferred in view of the chipping resistance, rust prevention, etc. of the film formed from the resulting intermediate coating (B). As the crosslinking agent, there can be used, for example, an amino resin (e.g. a melamine resin or a urea resin), a blocked or non-blocked polyisocyanate compound and a carboxyl group-containing compound.

As the fine aluminum powder used in the intermediate coating (B), there is used a fine aluminum powder having an average particle diameter of less than 10 μm, preferably 3–7 μm. An aluminum powder having an average particle diameter of more than 10 μm is not preferred because the film formed from the resulting coating has a low hiding power generally. Herein, "average particle diameter" refers to a median diameter as measured by laser diffraction scattering method (ok ?) (LA-500). The main component of the fine aluminum powder is metallic aluminum, and its surfaces may be coated with a silane coupling agent or the like.

As the titanium oxide pigment used in the intermediate coating (B), there can be used a a titanium oxide pigment per se known as a pigment for coating. The preferable average particle diameter of the titanium oxide powder is usually 5 μm or less. The surfaces of the titanium oxide pigment may be coated with alumina, silica or the like.

As to the amounts of the fine aluminum powder and the titanium oxide pigment used in the intermediate coating (B), the amount of the former can be 0.1–30 parts by weight, preferably 0.5–20 parts by weight, more preferably 1–7 parts by weight per 100 parts by weight of the thermosetting resin composition; and the amount of the latter can be 1–200 parts by weight, preferably 40–150 parts by weight, more preferably 80–120 parts by weight per 100 parts by weight of the thermosetting resin composition. Preferably, the amount of the fine aluminum powder is 1–15 parts by weight, preferably 1.5–10 parts by weight, more preferably 2–7 parts by weight per 100 parts by weight of the titanium oixde pigment.

The total amount of the fine aluminum powder and the titanium oxide pigment used in the intermediate coating (B) can be such that the film formed from the intermediate coating (B) has a hiding power of 25 μm or less, particularly 8–20 μm as cured. Herein, "hiding power" refes to the minimum thickness of a film formed on a substrate, at which the color of the substrate can not be seen through the film; and specifically is the minimum thickness of a film formed on a black and white checkered plate, at which the black and white of the plate can not be distinguished through the film with naked eyes. In the present process, by using, in the intermediate coating (B), the fine aluminum powder and the titanium oxide powder in combination in particular amounts, the film formed from the intermediate coating (B) can have a hiding powder as good as 25 μm or less.

The intermediate coating (B) can be produced by dispersing the above-mentioned components, i.e. a thermosetting resin composition, a fine aluminum powder and a titanium oxide pigment in a solvent such as organic solvent and/or water. The intermediate coating (B) can further contain, as necessary, a coloring pigment other than the fine aluminum powder and the titanium oxide pigment, an extender pigment, a dispersion stabilizer, etc.

The intermediate coating (B) is applied on the cured or uncured film of the primer (A) preferably by a method such as electrostatic coating, air spraying, airless spraying or the like in a film thickness (as cured) of 25 μm or less, particularly 10–25 μm, more particularly 13–23 μm.

The thus-formed film of the intermediate coating (B) can have a glass transition temperature (Tg) of generally 40° C. or less, preferably −60° C. to 40° C., more preferably −20° C. to 35° C.

In the present specification, the Tg of a coating film is a value obtained by applying a coating sample on a glass plate so as to form a film having a thickness (as cured) of 50 μm, curing the film at 140° C. for 30 minutes, peeling off the cured film from the glass plate, and measuring the isolated film for dynamic glass transition temperature (° C.) using a dynamic visco elastometer, MODEL VIBRON DDV-IIEA (a product of TOYO BACDWIN Co., Ltd.), at a frequency of 110 Hz at a temperature elevation rate of 3° C./min.

In the present process, a coloring base coating (C) may be applied on the uncured film of the intermediate coating (B). In general, however, the coloring base coating (C) is desired to be applied on the cross-linked and cured film of the intermediate coating (B). The film of the intermediate coating (B) can be cross-linked and cured, for example, by heating it at about 100–170° for about 10–40 minutes.

Coloring Base Coating (C)

According to the present process, on the above-formed cured or uncured film of the intermediate coating (B) is applied a coloring base coating (C). In the present process, there is used, as the coloring base coating (C), a thermosetting coloring coating containing a thermosetting resin composition, a titanium white pigment and an aluminum flake, the amounts of the titanium white pigment and the aluminum flake being such that a film formed from the coating has a value of N 7 to N 9 in Munsell's color system.

The coloring base coating (C) is preferably a thermosetting coating containing, as essential components, a thermosetting resin composition, a solvent, a titanium white pigment and an aluminum flake and, as necessary, other coloring pigment, an extender pigment, other additives for coating, etc.

The thermosetting resin composition used as a vehicle component in the coloring base coating (C), basically comprises a base resin and a crosslinking agent. Specific examples of the base resin are an acrylic resin, a polyester resin, an alkyd resin and a urethane resin all having, in the molecule, at least two crosslinkable functional groups selected from hydroxyl group, epoxy group, isocyanate group, carboxyl group, etc. An acrylic resin is particularly preferred in view of the weatherability, fine appearance, etc. of the film formed from the coloring base coating (C). The cross-linking agent includes, for example, a melamine resin, a urea resin and a blocked or non-blocked polyisocyanate compound. The base resin and the crosslinking agent are used by dissolving or dispersing them in a solvent such as organic solvent, water or mixture thereof.

The titanium white pigment is a white pigment composed mainly of titanium dioxide. It is generally preferable that this pigment has an average particle diameter of 0.2–0.35 μm, particularly 0.25–0.30 μm. The aluminum flake is scaly metal aluminum. It is generally preferable that this aluminum flake has a thickness of 0.1–1 μm, particularly 0.2–0.5 μm, particle diameters of 1–20 μm and an average particle diameter of 10 μm or less.

The base coating (C) is produced so as to be able to form a film having a value of N 7 to N 9, preferably N 7.5 to N 8.8 in Munsell's color system by using the titanium white pigment and the aluminum flake in combination. To satisfy the above requirement, it is generally preferable that the aluminum flake is used in an amount of preferably 0.5–10 parts by weight, more preferably 1–5 parts by weight per 100 parts by weight of the titanium white pigment and that the total amount of the two components is 40–250 parts by weight, particularly 60–200 parts by weight, more particularly 80–150 parts by weight per 100 parts by weight of the solid content of the thermosetting resin composition.

By controlling the titanium white pigment and the aluminum flake in such proportions, a coloring base coating film of a white to light gray color having no glitter can be formed. By coating, on such a film of the coloring base coating (C), a white-pearl-like or silver-pearl-like base coating (D), a novel decorative multilayer film superior in high white-iridescent appearance, etc. can be formed.

The coloring base coating (C) can be applied on the cured or uncured film of the intermediate coating (B) by a method such as electrostatic coating, air spraying, airless spraying or the like. The preferable thickness of the resulting film is generally 5–20 μm, particularly 8–18 μm as cured. The film can be cross-linked and cured by heating it at a temperature of about 100–170° C. for about 10–40 minutes; in the present invention, however, the film is not crosslinked or cured and a pearl-like base coating (D) is applied thereon while the film is still in an uncrosslinked and uncured state.

The thus-formed film of the coloring base coating (C) can have a glass transition temperature of generally 40–120° C., preferably 60–100° C., more preferably 80–95° C.

Pearl-like Base Coating (D)

As the pearl-like base coating (D) applied onto the film of the coloring base coating (C) according to the present process, there is generally used a white-pearl-like or silver-pearl-like liquid coating containing, as main components, a thermosetting resin composition, a scaly mica powder coated with titanium oxide, and a solvent and, as necessary, a coloring pigment, an extender pigment, other additives for coating, etc.

The thermosetting resin composition basically comprises a base resin and a crosslinking agent. Specific examples of the base resin are an acrylic resin, a polyester resin, an alkyd resin and a urethane resin all having, in the molecule, at least two crosslinkable functional groups selected from hydroxyl group, epoxy group, isocyanate group, carboxyl group, etc. An acrylic resin is particularly preferred. The crosslinking agent includes, for example, a melamine resin, a urea resin and a blocked or non-blocked polyisocyanate compound. The base resin and the crosslinking agent can be used by dissolving or dispersing them in a solvent such as organic solvent, water or mixture thereof.

The scaly mica coated with titanium oxide, used in the pearl-like base coating (0) is non-iridescent mica generally called "white mica" or "silver mica" and is distinguished from iridescent mica. The scaly mica powder whose particle surfaces are coated with titanium oxide, used in the present invention preferably has the maximum diameter of generally 5–60 μm, particularly 5–40 μm, more particularly 5–25 μm and a thickness of 0.25–1.5 μm, particularly 0.5–1 μm. In order for the film of the base coating (D) to have a white-pearl-like surface or a silver-pearl-like surface, it is preferable that the titanium oxide coated on the scaly mica powder generally has an optical thickness of 90–160 nm and a geometrical thickness of 40–70 nm.

There is no strict restriction as to the amount of the scaly mica coated with titanium oxide, but the preferable amount is generally 3–20 parts by weight, particularly 7–13 parts by weight per 100 parts by weight of the total solid content of the resin composition.

The pearl-like base coating (D) may further contain, as necessary, a silver-plated glass flake, titanium-coated graphite, a metal titanium flake, platy iron oxide, a phthalocyanine flake, etc.

The pearl-like base coating (D) can be coated on the cured or uncrosslinked uncured film of the coloring base coating (C) by a method such as electrostatic coating, air spraying, airless spraying or the like. The preferable thickness of the resulting film of the base coating (D) is 5–20 μm, particularly 8–18 μm as cured. The preferable total thickness of the film of the coloring base coating (C) and the film of the pearl-like base coating (D) is generally 30 μm or less, particularly 10–25 μm as cured. The film of the base coating (D) can be crosslinked and cured by heating it at a temperature of about 100–170° C. for about 10–40 minutes. In the present process, after curing the film substantially completely or partially, or without curing the film, a clear coating (E), which is described below, is coated thereon. The thus-formed film of the pearl-like base coating (D) can have the same Tg as the film of the coloring base coating (C).

Clear Coating (E)

The clear coating (E) is a coating which is applied onto the above-formed cured or uncured film of the pearl-like base coating (D) and which is capable of forming a clear film. As the clear coating (E), there can be used a liquid coating containing, as main components, a thermosetting resin composition and a solvent and further containing, as necessary, a coloring pigment, a metallic pigment, an ultraviolet absorber, other additives for coating, etc. to such an extent that the transparency of the film of the clear coating (E) is not impaired.

The thermosetting resin composition basically comprises a base resin and a crosslinking agent. Specific examples of the base resin are an acrylic resin, a polyester resin, an alkyd resin and a urethane resin all having, in the molecule, at least two crosslinkable functional groups selected from hydroxyl group, epoxy group, isocyanate group, carboxyl group, etc. The crosslinking agent includes, for example, a melamine resin, a urea resin and a blocked or non-blocked polyisocyanate compound. As the solvent, there can be used an organic solvent, water or a mixture thereof.

The clear coating (E) can be coated on the above-formed cured or uncured film of the pearl-like base coating (D) by a method such as electrostatic coating, air spraying, airless spraying or the like. The preferable thickness of the resulting film of the clear coating (E) is 10–100 μm, particularly 20–80 μm as cured. The film of the clear coating (E) can be cross-linked and cured by heating it at a temperature of about 100–170° C. for about 10–40 minutes.

In the present process, after the coloring base coating (C), the pearl-like base coating (D) and the clear coating (E) have been coated in this order, all on a wet-on-wet basis, the resulting three films can be heated at a temperature of about 100–160° C., preferably 120–150° C. for about 10–60 minutes to crosslink and cure them simultaneously (3-coat 1-bake). This operation can be carried out by steps consisting of the application of the coloring base coating (C)—room temperature standing (1)—the application of the pearl-like base coating (D)—room temperature standing (2)—the application of the clear coating (E)—heating for curing. Optionally, the room temperature standing (1) and/or the room temperature standing (2) may be replaced by preliminary drying at about 50–100° C., particularly at about 60–80° C. This preliminary drying is preferably carried out to such an extent that the gel fraction of each film remains at 60% by weight or less, particularly at 50% by weight or less.

The following meritorious effects are provided by the present process.

(1) By using, as the intermediate coating (B), a liquid thermosetting coating containing a thermosetting resin composition, a fine aluminum powder having an average particle diameter of less than 10 μm and a titanium oxide pigment, the amounts of the fine aluminum powder and the titanium oxide pigment being 0.1–30 parts by weight and 1–200 parts by weight, respectively, per 100 parts by weight of the thermosetting resin composition so that a film formed from the liquid thermosetting coating has a hiding powder of 25 μm or less, the intermediate coating (B) can be applied in a small thickness to hide the surface of the film of the primer (A). Further, by using such a liquid thermosetting coating as the intermediate coating (B), the multilayer film formed by the present process can have improved chipping resistance.

(2) The coloring base coating (C) containing a titanium white pigment and an aluminum flake and thereby capable of forming a film having a value of N 7 to N 9 in Munsell's color system, has a very high hiding power. Therefore, the multilayer film formed by the present process is remarkably improved in high white-iridescent appearance, color stability, etc. even when the total thickness of the film of the base coating (C) and the film of the base coating (D) is as small as 30 μm or less.

(3) The scaly mica powder coated with titanium oxide, used in the pearl-like base coating (D) has a white pearl tone or a silver pearl tone. Therefore, the Go multilayer film formed by the present process is superior in high white-iridescent appearance, color stability, etc.

The present invention is hereinafter described more specifically by way of Examples and Comparative Examples. In the followings, parts and % are by weight unless otherwise specified.

I. SAMPLES (1) Primer (A)

A cationic electrocoating: ELECRON 9400HB (trade name), a product of Kansai Paint Co., Ltd. containing an epoxy-polyamine type cationic resin and a blocked polyisocyanate compound (a curing agent).

(2) Intermediate Coatings (B)

(B-1) to (B-5) are each an organic solvent type coating containing a hydroxyl group-containing polyester resin, a melamine resin, a fine aluminum powder and a titanium oxide pigment in the proportions shown in the following Table 1. In Table 1, the proportions of individual components are by weight based on the solid contents.

TABLE 1

| | Intermediate coatings (B) | | | | |
|---|---|---|---|---|---|
| | B-1 | B-2 | B-3 | B-4 | B-5 |
| Polyester resin (*1) | 65 | 70 | 75 | 70 | 70 |
| Melamine resin (*2) | 35 | 30 | 25 | 30 | 30 |
| Fine aluminum powder (*3) | 5 | 2 | 2 | — | 2 |
| Titanium oxide pigment (*4) | 120 | 100 | 80 | 80 | — |
| Hiding power (μm) (*5) | 11 | 13 | 15 | 100 | 50 |
| Glass transition temp. (° C.) | 35 | 35 | 30 | 35 | 35 |

(*1) Phthalic anhydride/hexahydrophthalic anhydride type polyester resin (number-average molecular weight = about 4,000, hydroxyl value = 82, acid value = 7)
(*2) U-Van 28-60 (a product of MITSUI TOATSU CHEMICALS, INC.)
(*3) K-9800 (a product of Ashai Chemical Industry Co., Ltd., average particle diameter = 5–6 μm)
(*4) Titanium JR701 (a product of TEIKOKU kAKO CO., LTD., average particle diameter = 0.3–0.6 μm)
(*5) The minimum thickness (μm) of a film formed on a black and white checkered plate, at which the black and white of the plate can not be distinguished through the film with naked eyes.

(3) Coloring Base Coatings (C)

(C-1) to (C-4) are each an organic solvent type coating containing a resin component (consisting of a hydroxyl group-containing acrylic resin and a melamine resin), a titanium white pigment, an aluminum flake and carbon black in the proportions (by weight) shown in the following Table 2. In Table 2, the proportions of the hydroxyl group-containing acrylic resin and the melamine resin are shown based on the respective solid contents.

TABLE 2

| | Coloring base coating (C) | | | |
|---|---|---|---|---|
| | C-1 | C-2 | C-3 | C-4 |
| Hydroxyl group-containing acrylic resin (*6) | 70 | 70 | 70 | 70 |
| Melamine resin (*7) | 30 | 30 | 30 | 30 |
| Titanium white pigment (*8) | 100 | 100 | 100 | 100 |
| Aluminum flake (*9) | 2.5 | 1.3 | — | — |
| Carbon black (*10) | — | — | 0.1 | 0.05 |
| N value in Munsell's chart | 8.4 | 8.8 | 8.4 | 8.8 |
| Hiding power (μm) (*5) | 9 | 10 | 20 | 30 |
| Glass transition temp. (° C.) | 90 | 90 | 90 | 90 |

(*6) Hydroxy group-containing acrylic resin: hydroxyl value = 110, number-average molecular weight = 25,000
(*7) Melamine resin: butyl-etherified melamine resin
(*8) Titanium white pigment: rutile type titanium oxide pigment, a product of TEIKOKU KAKO CO., LTD., particle diameter = 0.25–0.30 μm
(*9) Aluminum flake: non-reefing aluminum paste, a product of TOKYO ALUMINUM K. K., thickness = 0.2–0.5 μm, average particle diameter = 10 μm or less
(*10) Carbon black: BLACK PEARL S1300, a product of CABOT CO.

(4) Coloring base coating (C-5)

An aqueous emulsion type coating containing 100 parts by weight (as solid content) of a resin emulsion [consisting of 65 parts of a hydroxyl group-containing acrylic resin (*11), 15 parts of a urethane resin (*12) and 20 parts of a melamine resin (*13)], 100 parts of a titanium white pigment (*8 in Table 2) and 2.5 parts of an aluminum flake (*9 in Table 2). N value in Munsell's color system=8.4; hiding power=10 μm; glass transition temperature=85° C.

(*11) Hydroxyl group-containing acrylic resin: an emulsion having an average particle diameter of 0.1 μm and a hydroxyl value of 30, neutralized with dimethylethanolamine.

(*12) Urethane resin: an emulsion obtained by means of chain extension reaction with water, neutralized with triethylamine.

(*13) Melamine resin: U-Van 28SE (trade name), a product of MITSUI TOATSU CHEMICALS, INC., a hydrophobic melamine resin.

(5) Pearl-like base coatings (D)

(D-1): an organic solvent type coating containing 70 parts of a hydroxyl group-containing acrylic resin (*14), 30 parts of a butylated melamine resin (*14) and 10 parts of scaly mica coated with titanium oxide [maximum diameter=10–20 μm, thickness=0.5–1 μm, optical thickness of titanium oxide=about 140 nm, geometrical thickness of titanium oxide=about 60 nm, IRIODIN 103R (trade name), a product of Merck Co.)]; solid content=20%; glass transition temperature=90° C.

(*14) Hydroxyl group-containing acrylic resin: hydroxyl value=100, number-average molecular weight=20,000.

(*15) Butylated melamine resin: a methyl- and butyl-etherifed melamine resin.

(D-2): an aqueous coating containing 100 parts by weight (as solid content) of an aqueous resin emulsion [consisting of 65 parts of a hydroxyl group-containing acrylic resin (*16), 15 parts of a urethane resin (*17) and 20 parts of a melamine resin (*18)] and 10 parts of scaly mica coated with titanium oxide (IRIODIN 103R mentioned above); solid content=20%; glass transition temperature=85° C.

(*16) Hydroxyl group-containing acrylic resin: an emulsion having an average particle diameter of 0.1 μm and a hydroxyl value of 35, neutralized with dimethylethanolamine.

(*17) Urethane resin: an emulsion obtained by means of chain extension reaction with water, neutralized with triethylamine.

(*18) Melamine resin: U-Van 28SE (trade name), a product of MITSUI TOATSU CHEMICALS, INC., a hydrophobic melamine resin.

(6) Clear Coating (E)

LUGABAKE CLEAR (trade name), a product of Kansai Paint Co., Ltd., an acrylic resin-amino resin system, an organic solvent type, glass transition temperature=90° C.

II. EXAMPLES AND COMPARATIVE EXAMPLES

On a degreased and zinc phosphate-treated steel plate (JIS G 3141, 400 mm×300 mm×0.8 mm) was electrocoated, by an ordinary method, a cationic electrocoating so as to give a film of 20 μm in thickness as cured. The coated cationic electrocoating was heated at 170° C. for 20 minutes for crosslinking and curing.

On the cured film of the cationic electrocoating formed on the steel plate was coated one of the intermediate coatings (B-1) to (B-5) by the use of a minibell type rotary static electrocoating machine under the conditions of discharge amount=180 cc, 40,000 rpm, shaping pressure=1 kg/cm$^2$, gun distance=30 cm, conveyor speed=4.2 m/min, booth temperature=20° C. and booth humidity=75%. The coated intermediate coating was heated at 140° C. for 30 minutes for crosslinking and curing. The thickness of the resulting film of the intermediate coating was 15 μm as cured.

On the cured film of the intermediate coating was coated one of the coloring base coatings (C-1) to (C-4) by the use of a minibell type rotary static electrocoating machine under the conditions of discharge amount=180 cc, 40,000 rpm, shaping pressure=1 kg/cm$^2$, gun distance=30 cm, conveyor speed=4.2 m/min, booth temperature=20° C. and booth humidity=75%. The thickness of the resulting film of the coloring base coating was 10 μm as cured.

Then, on the uncured film of the coloring base coating was coated, in two stages, one of the pearl-like base coatings (D-1) and (D-2) by the use of a REA gun under the conditions of discharge amount=180 cc, atomization pressure=2–5 kg/cm$^2$, pattern pressure=3.0 kg/cm$^2$, gun distance=35 cm, conveyor speed=4.2 m/min, booth temperature=20° C. and booth humidity=75%. The thickness of the resulting film of the pearl-like base coating was 4–5 μm as cured, in each stage and 8–10 μm as cured, in total.

Then, on the uncured film of the pearl-like base coating was coated the clear coating (E) by the use of a minibell type rotary static electrocoating machine under the conditions of discharge amount=320 cc, 40,000 rpm, shaping pressure=1.2 kg/cm$^2$, gun distance=30 cm, conveyor speed=4.2 m/min, booth temperature=20° C. and booth humidity=75%. The thickness of the resulting film of the clear coating (E) was 25 μm as cured.

The resulting plate was allowed to stand in a room for 3 minutes and then heated at 140° C. for 30 minutes in a dryer of hot air circulation type to subject the three-layered films of the coloring base coating, the pearl-like base coating and the clear coating simultaneously to crosslinking and curing.

III. PERFORMANCES OF MULTILAYER FILMES

The plates each having a multilayer film formed thereon, prepared in Examples and Comparative Examples were measured for the performances of respective multilayer films. The results are shown in Table 3, together with the outline of the above coating operation.

TABLE 3

| | | Examples | | | | Comparative Examples | | | | | |
|---|---|---|---|---|---|---|---|---|---|---|---|
| | | 1 | 2 | 3 | 4 | 1 | 2 | 3 | 4 | 5 | 6 |
| Primer | Name | ELECRON 9400 HB | | | | | | | | | |
| | Curing | 170° C. × 20 min | | | | | | | | | |
| Intermediate coating | Symbol | B-1 | B-1 | B-2 | B-3 | B-4 | B-4 | B-4 | B-4 | B-4 | B-5 |
| | Film thickness (μm) | 20 | 20 | 20 | 20 | 20 | 20 | 20 | 35 | 35 | 20 |
| | Curing | 140° C. × 30 min | | | | | | | | | |
| Coloring base coating | Symbol | C-1 | C-2 | C-2 | C-5 | C-2 | C-3 | C-4 | C-4 | C-4 | C-2 |
| | Film thickness (μm) | 10 | 10 | 10 | 10 | 10 | 10 | 10 | 20 | 35 | 10 |
| | Drying | W | W | W | W | W | W | W | W | H | W |
| Pearl-like base coating | Symbol | D-1 | D-1 | D-2 | D-1 | D-1 | D-1 | D-1 | D-1 | D-1 | D-1 |
| | Film thickness (μm) | 10 | | | | | | | | | |
| | Drying | W | W | W | W | W | W | W | W | W | W |
| Clear coating | Name | LUGABAKE CLEAR | | | | | | | | | |
| | Curing | 140° C. × 30 min | | | | | | | | | |

TABLE 3-continued

| | | Examples | | | | Comparative Examples | | | | | |
|---|---|---|---|---|---|---|---|---|---|---|---|
| | | 1 | 2 | 3 | 4 | 1 | 2 | 3 | 4 | 5 | 6 |
| Performance test results | | | | | | | | | | | |
| Chipping resistance | | A | A | A | A | B | B | B | B | A | B |
| Iridescence | SV | 270 | 250 | 250 | 250 | 250 | 280 | 300 | 275 | 250 | 275 |
| feeling | IV | 116 | 115 | 115 | 115 | 115 | 117 | 117 | 116 | 116 | 116 |
| Unevenness | | A | A | A | A | A | B | C | B | A | B |
| Total thickness of intermediate coating film and coloring base coating film (μm) | | 30 | 30 | 30 | 30 | 30 | 30 | 30 | 55 | 70 | 30 |

In "Drying" of Table 3, W refers to that the coated plate was allowed to stand at room temperature for 3–5 minutes, and H refers to that the coated plate was dried at 60° C. for 10 minutes.

The performance of each multilayer film was measured by the following test methods.

Chipping Resistance

Each plate coated with a primer coating, an intermediate coating, a coloring base coating, a pearl-like base coating and a clear coating and subjected to heating and curing was tested under the following conditions.

(1) Tester: Q-G-R Gravelometer (trade name, a product of Q Panel Co.)

(2) Stones sprayed: crushed stones having diameters of about 15–20 mm (3) Volume of stones sprayed: about 500 ml (4) Air pressure used for spraying: about 4 kg/cm$^2$ (5) Test temperature: about 20° C.

A test piece was fixed to a test piece holder. About 500 ml of crushed stones were hit against the film surface of the test piece at an air pressure of about 4 kg/cm$^2$. The condition of the film surface after hitting was visually examined and evaluated according to the following standard.

A: (good) very slight scar caused by impact is seen in part of the clear coating film, and there is no peeling of the pearl-like base coating film.

B: (borderline good) scar caused by impact is seen in the clear coating film, the pearl-like base coating film and the coloring base coating film, and peeling caused by impact is seen in some places of the intermediate coating film and the primer coating film.

C: (poor) much peeling caused by impact is seen in the intermediate coating film, and considerable peeling caused by impact is seen in the electrocoating film.

Iridescence Feeling

SV (scatter value) and IV (intensity value) were measured using ALCOPE LMR 100 (trade name) (a product of Kansai Paint Co., Ltd.). SV is measured as follows. A laser beam is applied on a clear film at an incident angle of 45°; a reflected light of regular reflection territory, giving the minimum intensity is captured; the intensity of the light is converted to a single output; and the signal output is converted to SV using a given formula. SV indicates the intensity (whiteness, degree of light scattering) of the diffuse reflection light generated by the striking of the laser beam upon scaly mica. A higher SV indicates a higher whiteness. IV is measured as follows. A laser beam is applied on a clear film at an incident angle of 45°; a reflected light of non-specular reflection territory, giving the maximum intensity is captured; the intensity of the light is converted to a signal output; and the signal output is converted to IV using a given formula. IV indicates the intensity (luminance, brightness and metallic luster) of the regular reflection light generated by the striking of the laser beam upon scaly mica. A higher IV indicates a higher metallic luster feeling.

Unevenness

Visually examined in a room by ten experienced testers in charge of testing film finish. The ratings by the ten testers were totalized. A indicates "good"; B indicates "borderline good"; and C indicates "bad".

What we claimed is:

1. A process for forming a multilayer film by applying, on a substrate, the following coatings in the following order:

(A) a primer, (B) an intermediate coating, (C) a coloring base coating, (D) a pearl-colored base coating, and (E) a clear coating, in which process the intermediate coating (B) is a liquid thermosetting coating containing a thermosetting resin composition, a fine aluminum powder having an average particle diameter of less than 10 μm and a titanium oxide pigment, the amounts of the fine aluminum powder and the titanium oxide pigment being 0.1–30 parts by weight and 1–200 parts by weight, respectively, per 100 parts by weight of the thermosetting resin composition so that a film formed from the liquid thermosetting coating has a hiding powder of 25 μm or less; the coloring base coating (C) is a coating containing a thermosetting resin composition, a titanium white pigment and an aluminum flake, the amounts of the titanium white pigment and the aluminum flake being such that a film formed from the coating has a value of N 7 to N 9 in Munsell's color system; and the pearl-colored base coating (D) is a white-pearl-colored or silver-pearl-colored coating containing a thermosetting resin composition and a scaly mica powder coated with titanium oxide.

2. A process according to claim 1, wherein the average particle diameter of the fine aluminum powder contained in the intermediate coating (B) is in the range of 3–7 μm.

3. A process according to claim 1, wherein in the intermediate coating (B), the amounts of the fine aluminum powder and the titanium oxide pigment are 1–7 parts by weight and 80–120 parts by weight, respectively, per 100 parts by weight of the thermosetting resin composition.

4. A process according to claim 1, wherein in the intermediate coating (B), the thermosetting resin composition comprises a crosslinkable functional group-containing base resin and a crosslinking agent, the base material resin being a polyester resin.

5. A process according to claim 1, wherein the intermediate coating (B) is capable of forming a film having a glass transition temperature of 40° C. or less.

6. A process according to claim 1, wherein in the intermediate coating (B), the total amount of the fine aluminum powder and the titanium oxide pigment is such that the film formed from the intermediate coating (B) has a hiding power of 25 μm or less.

7. A process according to claim 1, which comprises applying the coloring base coating (C) after the application of the intermediate coating (B) and subsequent crosslinking and curing of the film formed from the intermediate coating (B).

8. A process according to claim 1, wherein the film formed from the intermediate coating (B) has a film thickness of 10–25 μm as cured.

9. A process according to claim 1, wherein the coloring base coating (C) is capable of forming a colored film having a value of N 7.5 to N 8.8 in Munsell's color system.

10. A process according to claim 1, wherein the titanium white pigment in the coloring base coating (C) has an average particle diameter of 0.2–0.35 μm.

11. A process according to claim 1, wherein the aluminum flake in the coloring base coating (C) has a thickness of 0.1–1 μm, particle diameters of 1–20 μm and an average particle diameter of 10 μm or less.

12. A process according to claim 1, wherein the coloring base coating (C) contains the aluminum flake in an amount of 0.5–10 parts by weight per 100 parts by weight of the titanium white pigment.

13. A process according to claim 1, wherein the coloring base coating (C) contains the aluminum flake in an amount of 1–5 parts by weight per 100 parts by weight of the titanium white pigment.

14. A process according to claim 1, wherein the coloring base coating (C) contains the titanium white pigment and the aluminum flake in a total amount of 40–250 parts by weight per 100 parts by weight of the solid content of the thermosetting resin composition.

15. A process according to claim 1, wherein the film of the coloring base coating (C) has a thickness of 5–20 μm as cured.

16. A process according to claim 1, wherein the coloring base coating (C) is capable of forming a film having a glass transition temperature of 80° C. to 100° C.

17. A process according to claim 1, wherein the scaly mica powder coated with titanium oxide is non-iridescent.

18. A process according to claim 1, wherein the scaly mica powder coated with titanium oxide has the maximum diameter of 5–60 μm and a thickness of 0.25–1.5 μm.

19. A process according to claim 1, wherein the scaly mica powder coated with titanium oxide is coated with titanium oxide in an optical thickness of 90–160 nm and a geometrical thickness of 40–70 nm.

20. A process according to claim 1, wherein the pearl-colored base coating (D) contains the scaly mica powder coated with titanium oxide, in an amount of 3–20 parts by weight per 100 parts by weight of the solid content of the thermosetting resin composition in the base coating (D).

21. A process according to claim 1, wherein the film of the base coating (D) has a thickness of 5–20 μm as cured.

22. A process according to claim 1, wherein the total thickness of the film of the base coating (C) and the film of the base coating (D) is 30 μm or less as cured.

23. A process according to claim 1, wherein the film of the clear coating (E) has a thickness of 10–100 μm as cured.

24. A process according to claim 1, wherein the coloring base coating (C), the pearl-colored base coating (D) and the clear coating (E) are applied on a wet-on-wet basis and then the resulting films of the coatings (C), (D) and (E) are heated at a temperature of about 100° C. to about 160° to cross-link and cure said films simultaneously.

25. A process according to claim 1, wherein preliminary drying is conducted at a temperature of about 50 to about 100° C. between the application of the coloring base coating (C) and the application of the white-pearl-colored or silver-pearl-colored base coating (D) and/or between the application of the white-pearl-colored or silver-pearl-colored base coating (D) and the application of the clear coating (E).

26. An article having a multilayer film formed by the process of claim 1.

* * * * *